US005155977A

United States Patent [19]

Dupont

[11] Patent Number: 5,155,977

[45] Date of Patent: Oct. 20, 1992

[54] NEWSPAPER BUNDLER

[76] Inventor: Max B. Dupont, 1870 Jefferson St. #204, San Francisco, Calif. 94123

[21] Appl. No.: 734,546

[22] Filed: Jul. 23, 1991

[51] Int. Cl.[5] ..... B65B 13/06; B65B 13/20; B65B 1/24

[52] U.S. Cl. ..... 53/528; 53/137.2; 53/540; 53/590; 53/592; 100/15; 100/34

[58] Field of Search ..... 53/399, 587, 390, 392, 53/592, 447, 540, 137.2, 590; 100/34, 15, 8, 220, 219, 233, 236

[56] References Cited

U.S. PATENT DOCUMENTS

| | | | |
|---|---|---|---|
| 944,929 | 12/1909 | Westwood | 100/34 |
| 2,811,916 | 11/1957 | Guilleminot | 100/15 |
| 2,818,180 | 12/1957 | Keene | 100/34 X |
| 3,262,246 | 7/1966 | Olsen et al. | 53/587 |
| 3,964,381 | 6/1976 | Koenen | 53/390 X |
| 5,022,316 | 6/1991 | Hellwig | 53/592 X |
| 5,042,371 | 8/1991 | Katz | 100/15 |

*Primary Examiner*—Horace M. Culver

*Attorney, Agent, or Firm*—James J. Leary; Kimberley Elcess

[57] ABSTRACT

A paper bundler for stacking and bundling recyclable paper waste, such as newspapers, magazines, and legal size or letter size office paper. The apparatus has two main parts, a basket and a cradle. The basket is made in two parts which are independently mounted to the cradle so they are free to rotate. Together, the halves of the basket form a paper receptacle which is rectangular and open at the top, with a gap in the middle for applying a strapping agent, such as masking tape. The cradle has a rectangular base and two vertical sides which support the rotating basket. A compression bar with a toggle latch is mounted on each half of the basket adjacent the gap between the two halves. The papers can be placed directly in the bundler as they are discarded. When the stack reaches a convenient size, the compression bars are used to compact the loose stack of newspapers into a tight bundle and hold them as the basket is rotated to apply the strapping agent to complete the bundling operation. The bundles thus formed are neat, compact, uniform in size, and very unlikely to come undone, even after rough handling.

19 Claims, 3 Drawing Sheets

NEWSPAPER BUNDLER

This invention relates to a recycling aid for newspaper and other waste paper. More particularly, it relates to a bundler for papers to be recycled that is easy to operate and that produces neat bundles of reproducible shape and size.

BACKGROUND OF THE INVENTION

These days more and more people are becoming aware of the strain that excessive waste puts on our natural resources. One of the easiest ways for an individual or a company to contribute to the reduction of that waste is by recycling. Newspapers and spent papers from the office can be recycled to produce grocery bags and cardboard boxes, among other things. This not only reduces the need for wood pulp to make the paper, but it reduces the load on our landfills. Newspaper is one of the largest components of waste in landfills today, and it decomposes so slowly that it is likely to remain a large contributor for many years to come.

While recycling sounds like a simple idea, it comes with a few irritations that result in less recycling by offices and households than might otherwise be the case. Take, for instance, the case of curbside pickup for recycling. This is surely a best case scenario since the recycler need only put the papers out to be collected once a week. Plastic bins to contain the papers are usually provided free of charge by the collection company. Unfortunately, these bins have their problems. Being of a fixed size, the bins place an absolute limit on the amount of paper that can be collected at one time. Since most users will wait until the bin is full, the bin is nearly always too heavy to be conveniently handled, by the householder or the collector, by the time it is placed on the curb. Then, again, there must be some use to which they are most perfectly suited, since the bins tend to disappear with appalling frequency, leaving the recycler and the collectors at a loss.

Even when collecting bins are used, some collectors require that recyclers put their papers in paper bags or tie them in stacks with twine or something similar. Putting recyclable paper, especially white office paper, into lower quality paper bags before recycling reflects a committee decision. Either the high quality paper is recycled along with the lower quality bag into a lower quality than necessary product, or the bags must be separated after collection and before recycling. The twine option may involve less sorting at the recyclery, although this is by no means clear, but it certainly involves more work on the part of the recycler. Most householders simply do not know how to tie an unruly stack of newspapers into a neat bundle that is robust enough to stay together after being thrown into a collection truck.

SUMMARY OF THE INVENTION

The objective of the present invention is to overcome the drawbacks of the prior art by providing an intermediate destination for newspapers and spent papers of any kind bound for the recyclery. It is also an objective of the invention to provide a convenient apparatus for stacking these papers into a compact and strudy bundle without twine or paper bags. A further objective is to encourage paper recycling by relieving the little irritations that can deter all but the most environmentally correct from persevering.

To this end, the present invention provides a modular paper bundler for stacking and bundling recyclable paper waste. The bundler may be made in different sizes to accommodate newspapers, magazines, legal size paper, and letter size paper. The papers can be placed directly in the bundler as they are discarded. Then, when the stack reaches a convenient size, the stack is bundled and the papers recycled.

The apparatus itself has two main parts, a basket and a cradle. The basket is chosen according to the size of paper to be bundled, for example a folded newspaper. The basket is made in two parts which are independently mounted to the cradle so they are free to rotate. Together, the halves of the basket form a paper receptacle which is rectangular, open at the top, and cut crosswise in the middle to create an opening for the strapping agent. The cradle matches the basket in size. It also has a rectangular shape with two vertical sides attached to the base.

A means for compressing the stack of newspapers is mounted on each half of the basket adjacent the gap between the two halves. These compressors serve to compact a loose stack of newspapers into a tight bundle and hold them as a strapping agent is applied to complete the bundling operation. The bundles thus formed are neat, compact, uniform in size, and very unlikely to come undone, even after rough handling.

A number of advantages accrue from the compression action of the newspaper bundler. Other objects and advantages of the invention will be made apparent by the following description and the accompanying drawings.

DESCRIPTION OF THE PREFERRED EMBODIMENT

Figure 1:
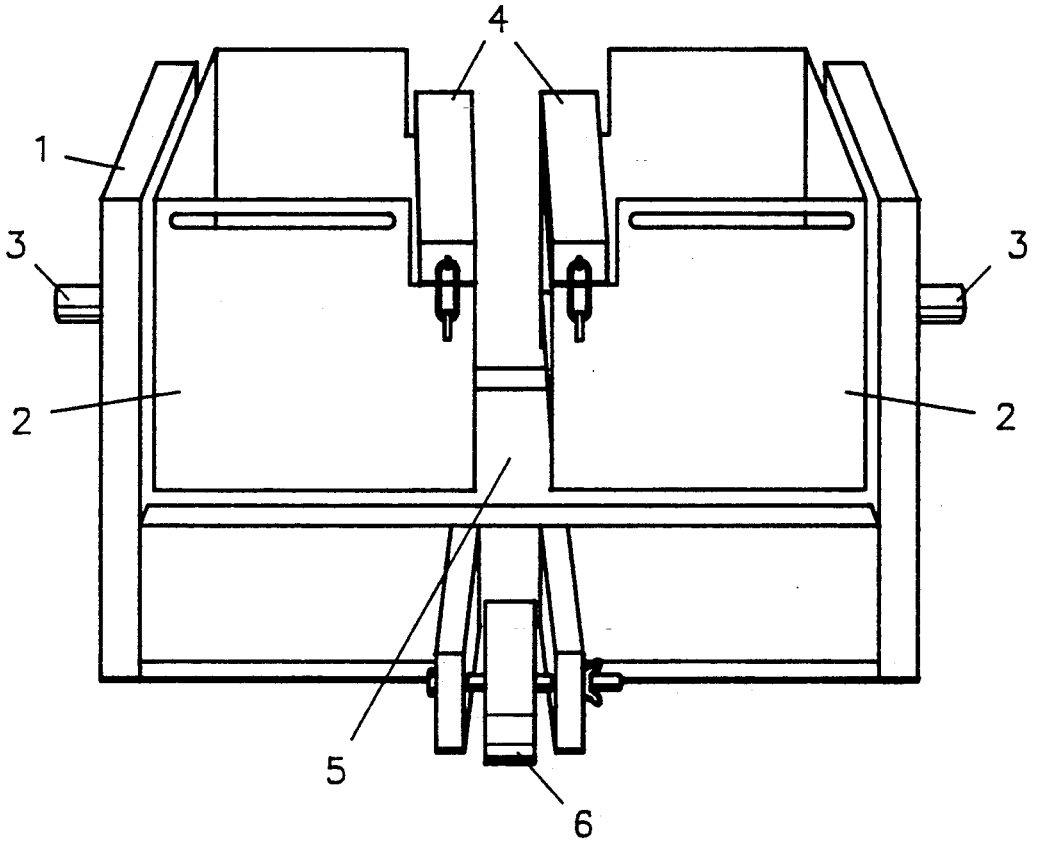
FIG. 1 is a perspective view of the newspaper bundler.

FIG. 1 shows a perspective view of the newspaper bundler built in accordance with the present invention. The two major parts of the bundler are the cradle 1 and the basket 2. The cradle 1 forms the base and the supporting structure for the basket 2. The basket 2 is actually made of two parts which are mirror images of one another. Each half of the basket 2 is rotatably attached to the cradle 1 by a bearing 3 that allows the halves of the basket 2 to rotate 360°.

Considered as a whole, the basket 2 forms a rectangular box which is open at the top and which has a gap 5 across the middle which separates the two sides of the basket 2. When sized for bundling newspapers, the basket 2 has inside measurements of approximately 14 inches long (including the gap 5 of about 1 inch), 12 inches wide, and 8 inches deep. These inside dimensions are just slightly larger than the size of a newspaper folded once, so that the newspapers will tend to align themselves into a neat bundle as they are stacked in the basket 2.

At the top of each half of the basket 2 is mounted a compressor 4 which is used to compress the loosely stacked newspapers into a tightly packed bundle before they are fastened together with a strapping agent dispensed from a dispenser 6 mounted on the cradle 1.

The bundler may be made from any material that is sufficiently rigid such as wood, plywood, metal, or plastic. Preferably, the bundler itself is made from recycled material such as molded recycled plastic.

Figure 2:
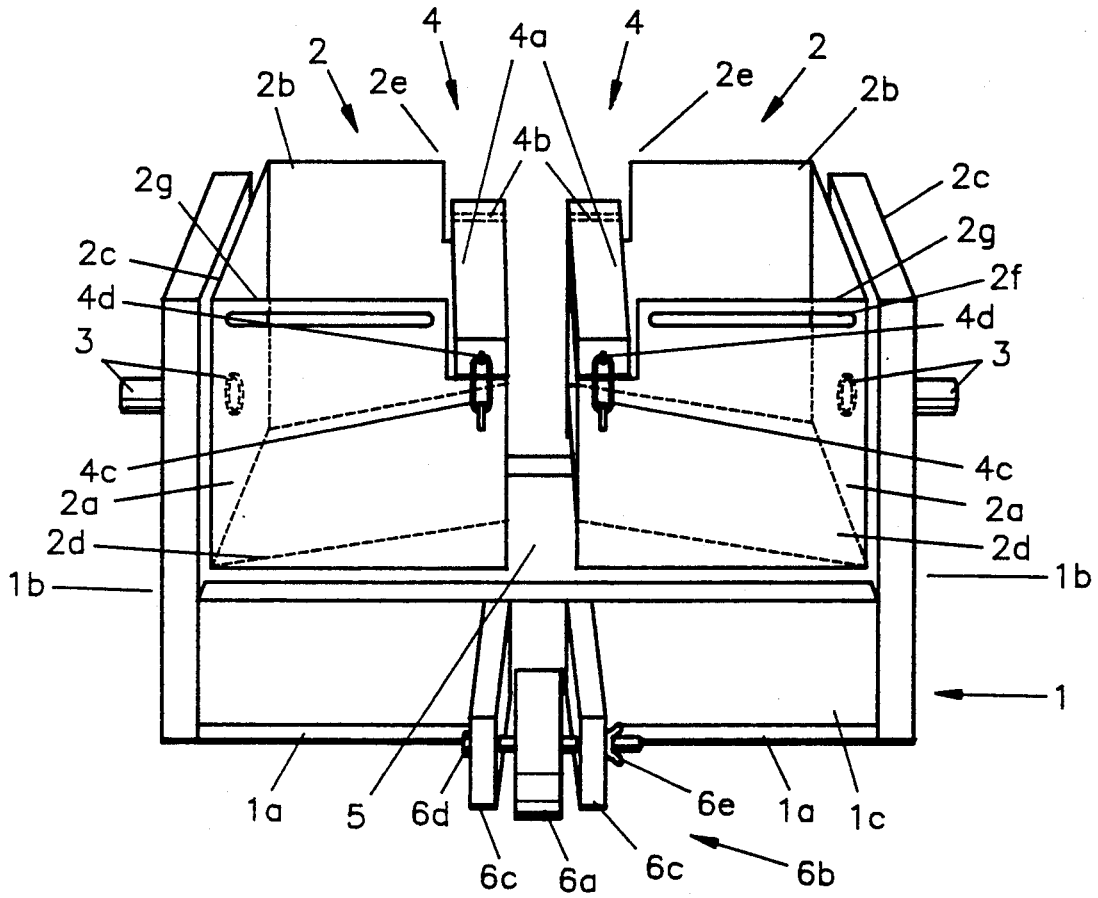
FIG. 2 is a phantom view showing the interior structure of the basket.

Please refer to FIG. 2 for the following detailed description of the newspaper bundler.

The cradle 1 has a base 1*a* and two vertical sides 1*b*. The sides 1*b* may be straight or tapered. A front wall 1*c* and a back wall (not shown) about three inches high are added to rigidify the cradle 1 and to hold the sides 1*b* perpendicular to the base 1*a*. Optionally, the sides 1*b* may be extended above the basket 2 and joined together at the top by a cross member (not shown) to further rigidify the structure.

Each half of the two-part basket 2 has a front wall 2*a*, a back wall 2*b*, a side wall 2*c*, and a bottom panel 2*d*. The two halves are mirror images of one another which go together to form one rectangular basket 2 with a gap 5 an inch or so wide between the two halves.

In the preferred embodiment, the bottom 2*d* of each side of the basket 2 is slanted so that it is higher near the gap 5 in the center of the basket 2 and lower near the sides 2*c* of the basket. This slanting of the bottom panel 2*d* adds to the compression of the stack of newspapers directly adjacent to the gap 5 in the basket. The compression from the slanted bottom panels 2*d* works together with the compressors 4 to optimally compact the stack of newspapers prior to bundling. An angle of about 22° from the horizontal has been found to be very effective for helping to compress materials like newspapers or junk mail, though higher or lower angles (right down to no slant at all) may be chosen for bundling other materials.

The sidewalls 2*c* of the basket 2 are rotatably mounted to the vertical sides 1*b* of the cradle 1 by a bearing 3 that allows each half of the basket to rotate 360° around axes which are collinear with one another. In the current model of bundler, each bearing 3 is made with a short axle which is attached to the basket sidewall 2*c* by a flange fitting. The axle passes through a hole in the vertical side 1*b* of the cradle 1 and is fastened on the other side with a heavy duty washer and a cotter pin. The diameter of the hole closely matches the diameter of the axle. Future models, it is anticipated, will have a larger diameter drum-shaped bearing with flanges for attachment to the basket 2 and the cradle 1.

The compressors 4 are an important component that gives the present invention significant advantages over the prior art. Each half of the basket 2 has a compressor 4 mounted near the top of the basket adjacent the gap 5. In the preferred embodiment each compressor 4 is made up of a compression bar 4*a* which is attached to the back wall 2*b* of the basket 2 by a hinge 4*b*, and which is removably attached to the front wall 2*a* by a latching device 4*c* and a catch 4*d*. The latch 4*c* should be of the reciprocating action type known as toggle clamps. (Examples of this type of latch can commonly be found on modern day ski boots). The latching device 4*c* provides a mechanical advantage for compressing the loosely stacked newspapers into a compact bundle prior to strapping. This type of clamp has the advantage that any downward pull on the lever of the clamp is automatically compensated by an equal upward force, thereby canceling out any downward pressure on the front of the basket in the compression process.

It should be understood that certain modifications to the compressors 4 can be made without departing from the spirit of the invention. For instance, the compression bars 4*a* may be made detachable from the basket 2 by replacing the hinges 4*b* with catches into which the rear of the compression bars 4*a* could be inserted. This would have the advantage that the compression bars 4*a* could be removed and stored, for instance in a compartment built into the cradle 1, when not needed. It should also be understood that the flat rectangular compression bars 4*a*, as illustrated, could be replaced with like elements of other configurations, such as rods, without departing from the scope of the invention.

An optional feature of the basket 2 is that the front walls 2*a* and the back walls 2*b* can have cutouts 2*e* in them at the top and adjacent to the gap 5 in the middle of the basket 2. The four cutouts 2*e* in the current model bundler measure 2¼ inches high by 1½ inches wide. These cutouts 2*e* perform two functions. First, they serve as markings for stacking newspapers in the basket 2. The top of the cutouts 2*e* mark the proper stacking height for the loosely stacked newspapers, and the bottom of the cutouts 2*e* marks the compressed height of the compacted newspapers. The second function is to provide a mounting place for the compressors 4, so that when the papers are fully compressed, the compression bars 4*a* rest on the bottom of the cutouts 2*e*. Thus, the cutouts 2*e* assure that the newspaper bundles are uniform in size and optimally compressed.

Another optional feature of the basket 2 is that handles or rails may be provided on the front wall 2*a* for easy grasping to facilitate rotation of the basket 2. An easy way to add this feature is to cut a slot 2*f* near the top of the front wall 2*a*. This effectively turns the top edge of the front wall 2*a* into an easy to grasp handle 2*g*.

The strapping agent dispenser 6 is mounted on the base 1*a* of the cradle 1 aligned with the gap 5 in the basket 2. The dispenser 6 contains a supply of a strapping agent 6*a*. The strapping agent can be string or adhesive tape or any other appropriate strapping agent. The preferred strapping agent 6*a* is a roll of ordinary masking tape. Masking tape has a number of advantages. First, it is cheap and readily available. Second, it is made of paper and therefore can be recycled along with the newspapers. Third, because it is adhesive backed, the end of the tape can be attached to the compressed newspapers anywhere along the gap 5, and when the basket 2 is rotated, the masking tape 6*a* automatically applies itself to the newspaper bundle.

It is preferable that the masking tape or other strapping agent 6*a* be applied under tension. This assures that the tape is applied tightly and uniformly around the bundle, for the optimum adhesion. The tension can be supplied by a friction device 6*b* that resists the rotation of the roll of tape as it unwinds. The dispenser 6 in the current model has a friction device 6*b* that has a bolt 6*d* that passes through the sides 6*c* of the dispenser and through the center of the roll of masking tape 6*a*. When a wing nut 6*e* on the end of the bolt 6*d* is tightened, it presses the sides 6*c* of the dispenser against the roll of tape 6*a* to cause friction.

Figure 3:
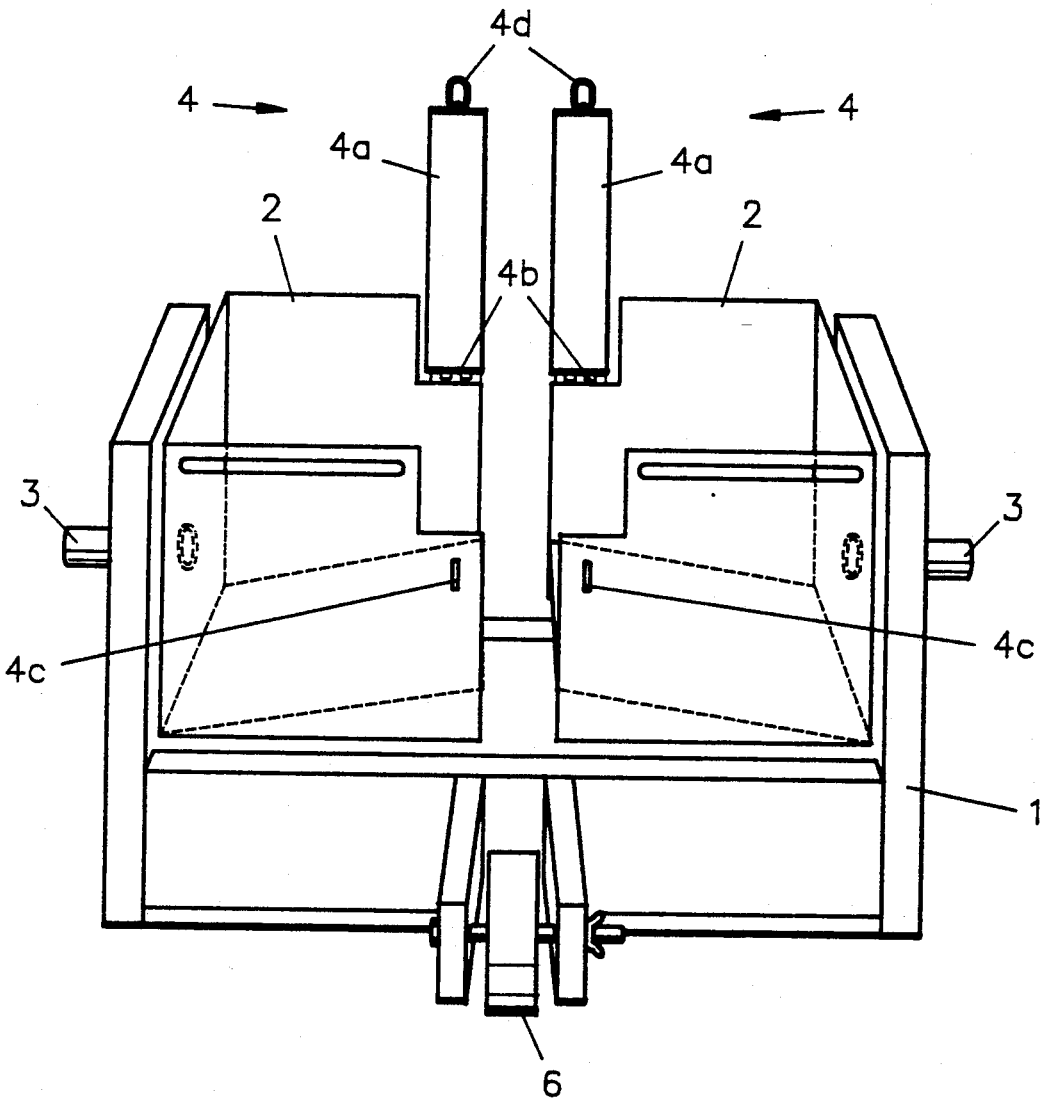
FIG. 3 shows the newspaper bundler with the compression bars in the open position to allow loading of the bundler.

FIG. 3 is provided to show the compressors 4 in the open position so that newspapers can be stacked in the basket 2. The catches 4*d* separate from the latches 4*c* so that the compression bars 4*a* can be rotated upward and out of the way.

OPERATIONAL DESCRIPTION

The operation of the bundler has three steps—stacking, compression and bundling:

STACKING

For loading, the compression bars 4*a* are retracted, as shown in FIG. 3, or removed, and each part of the basket 2 is aligned with the open part facing upward. The material to be processed is fed into the basket approximately horizontally, so that is can align itself with the basket as it settles to the bottom. Large items can be folded to fit, while small items can be placed more or less in the center so the stack comes out even. The material is loaded in until the loose stack reaches the level of the top of the cutouts 2*e*.

COMPRESSION

When the basket 2 is full, the compression bars 4*a* are repositioned on top of the stack. The catch 4*d* on the front end of the compression bar 4*a* engages the latch 4*c* which is mounted directly below the cutout 2*e* on the front of the basket. The latch is then closed, compressing the stack to the level of the bottom of the cutouts 2*e*. Once the latches 2*c* are closed, the two halves of the basket are effectively locked together so the entire basket 2 rotates as a unit.

BUNDLING

The placement of the compression means 4 and the latches 2*c* is designed to leave an opening 5 for strapping the bundle. The adhesive tape is attached to the newspapers at the top of the stack or anywhere else along the gap 5, then the basket is rotated to apply the tape all the way around the stack. As the tape is used up, the tension can be adjusted by turning the wing nut 6*e* on the dispensing unit 6. Up to the point at which rotation is restricted, more tension on the tape produces a better result. One complete turn of the basket is generally enough, but there is no limit to the number of turns through which the basket can be rotated, each turn contributing one layer of tape.

After the bundle has been strapped, the compression means 4 are freed from their latches 4*c* and retracted or removed. The stack will rebound against the tape, increasing the adhesion between the two, still further reducing the possibility that the bundle will come undone. The result is always a perfectly aligned, properly compressed, and virtually indestructible bundle of consistent size and weight, ready for private delivery or curbside collection.

CONCLUSIONS, RAMIFICATIONS AND SCOPE

Although the above examples include many specificities, they are intended as illustrative of only one possible embodiment of the invention. Other embodiments and possible modifications will, no doubt, occur to those skilled in the art. An example of such a modification would be to motorize the compressors or the basket so the bundling operation is carried out automatically. As well, the present invention may be used for bundling a wide variety of materials other than waste paper. Thus, the examples given should only be interpreted as illustrations of some of the preferred embodiments of the invention, and the full scope of the invention should be determined by the appended claims and their legal equivalents.

I claim:

1. An Apparatus for bundling newspapers or other papers, comprising:

a frame, having a base and two spaced apart side support members extending upward from said base, a basket for receiving newspapers or scrap paper rotatably mounted between said side support members, said basket being made in two parts, each of said basket parts having a front panel, a back panel, a bottom panel and a side panel, each of said basket parts being open on the top and on their adjacent sides, each of said side panels being rotatably mounted respectively one on each of said side support members, a space of sufficient width to allow passage of a strapping agent near the center of said basket separating said basket parts such that each of said basket parts is free to rotate independently, a compression means mounted on each of said basket parts, said compression means being adapted to compress a loosely piled stack of papers into a compressed stack, said compression means also serving to secure said stack of paper into said basket parts such that said basket parts and said stack of paper may be rotated as a unit so that said strapping agent may be easily used to secure said papers into a compressed bundle, said compression means comprising a compression bar having two ends, one end of said bar being pivotably attached to said back panel of one of said basket parts and the other end having a clamping mechanism for removable attachment of said bar to said front panel of said basket part, said clamping mechanism being adapted to provide a mechanical advantage for compression of said stack of papers with said compression bar.

2. The apparatus of claim 1 wherein said compression means are mounted adjacent said space between said basket parts.

3. The apparatus of claim 2 wherein said bottom panels are slanted such that said bottom panels are highest on their edges nearest said open adjacent sides of said basket parts and lowest on their edges nearest said side panels of said basket parts, and said compression means are adapted to cooperate with said slanted bottom panels to compress a loosely piled stack of papers into a compressed stack.

4. The apparatus of claim 1 wherein said compression means are permanently attached to said back panel in a pivotable fashion.

5. The apparatus of claim 1 wherein said compression means are removably attached to said back panel in a pivotable fashion.

6. The apparatus of claim 1 wherein said clamping mechanism comprises a toggle-action latch which provides a mechanical advantage for compression of said stack of papers with said compression bar.

7. The apparatus of claim 1 wherein said basket is made to specific dimensions such that said apparatus produces bundles of a predetermined size and weight.

8. The apparatus of claim 1 further comprising a dispenser for said strapping agent.

9. The apparatus of claim 8 wherein said dispenser further comprises a tensioning means so that said strapping agent is applied to said compressed stack of papers under tension.

10. The apparatus of claim 1 wherein said strapping agent is selected from the group comprising: string, wire, plastic tape, plastic strapping, adhesive tape, masking tape and paper tape.

11. The apparatus of claim 1 wherein said strapping agent is made of materials that are recyclable with said papers.

12. The apparatus of claim 1 wherein said basket is made such that it balances in an upright position free of unwanted rotation when it is empty or when it is filled with papers.

13. An Apparatus for bundling newspapers or other papers, comprising:

a frame, having a base and two spaced apart side support members extending upward from said base, a basket for receiving newspapers or scrap paper rotatably mounted between said side support members, said basket being made in two parts, each of said basket parts having a front panel, a back panel, a bottom panel and a side panel, each of said basket parts being open on the top and on their adjacent sides, each of said side panels being rotatably mounted respectively one on each of said side support members, wherein said basket is made to specific dimensions such that said apparatus produces bundles of a predetermined size and weight, a space of sufficient width to allow passage of a strapping agent near the center of said basket separating said basket parts such that each of said basket parts is free to rotate independently, a compression means mounted on each of said basket parts, said compression means being adapted to compress a loosely piled stack of papers into a compressed stack, said compression means also serving to secure said stack of paper into said basket parts such that said basket parts and said stack of paper may be rotated as a unit so that said strapping agent may be easily used to secure said papers into a compressed bundle, and a cut-out in one or more of said front panels or said back panels, such that the top edge of said cut-out indicates the proper stacking height for loosely piled newspapers to obtain a bundle of a predetermined weight and the bottom edge of said cut-out indicates the compressed height of said bundle.

14. The apparatus of claim 13 comprising four of said cut-outs, one in each of said front panels and said back panels adjacent to said space, said compression means being mounted at the bottom edge of said cut-outs so that the compressed height of said stack of papers coincides with the bottom of said cut-outs.

15. An apparatus for bundling newspapers or other materials, comprising:

a frame, having a base and two spaced apart side support members extending upward from said base, a basket for receiving newspapers or other material rotatably mounted between said side support members, said basket being made in two parts, each of said basket parts having a front panel, a back panel, a bottom panel and a side panel, each of said basket parts being open on the top and on their adjacent sides, each of said side panels being rotatably mounted respectively one on each of said side support members, said bottom panels being slanted such that said bottom panels are highest on their edges nearest said open adjacent sides of said basket parts and lowest on their edges nearest said side panels of said basket parts, a space of sufficient width to allow passage of a strapping agent near the center of said basket separating said basket parts such that each of said basket parts is free to rotate independently, a compression means mounted at the top of each of said basket parts adjacent said space, said compression means being adapted to cooperate with said slanted bottom panels to compress a loosely piled stack of material into a compressed stack, said compression means also serving to secure said stack of material into said basket parts such that said basket parts and said stack of material may be rotated as a unit so that said strapping agent may be easily used to secure said material into a compressed bundle.

16. The apparatus of claim 15 wherein each of said compression means comprises a compression bar having two ends, one end of said bar being pivotably attached to said back panel of one of said basket parts and the other end having a clamping mechanism for removable attachment of said bar to said front panel of said basket part, said clamping mechanism being adapted to provide a mechanical advantage for compression of said stack of material with said compression bar.

17. The apparatus of claim 16 further comprising a cut-out in one or more of said front panels or said back panels, such that the top edge of said cut-out indicates the proper stacking height for loosely piled newspapers to obtain a bundle of a predetermined weight and the bottom edge of said cut-out indicates the compressed height of said bundle.

18. The apparatus of claim 17 comprising four of said cut-outs, one in each of said front panels and said back panels adjacent to said space, said compression means being mounted at the bottom edge of said cut-outs so that the compressed height of said stack of papers coincides with the bottom of said cut-outs.

19. The apparatus of claim 15 wherein said basket is made such that it balances in an upright position free of unwanted rotation when it is empty or when it is filled with material.

* * * * *